United States Patent [19]

De Rossi

[11] 4,215,661

[45] Aug. 5, 1980

[54] MIXTURE REGULATING DEVICE

[75] Inventor: Mario De Rossi, Caracas, Venezuela

[73] Assignee: Metal Elio C.A. Una compänia de acuerdo con las Leyes Venezolanas, Venezuela

[21] Appl. No.: 937,438

[22] Filed: Aug. 28, 1978

[51] Int. Cl.[2] ..... F02M 3/08

[52] U.S. Cl. ..... 123/587; 261/DIG. 38; 261/41 D

[58] Field of Search ..... 123/119 D, 124 R; 261/63, DIG. 38, 41 D

[56] References Cited

U.S. PATENT DOCUMENTS

| | | | |
|---|---|---|---|
| 1,549,624 | 8/1925 | Stransky | 123/124 R |
| 3,077,341 | 2/1963 | Schlichting | 261/DIG. 38 |
| 3,346,244 | 10/1967 | Bess | 261/DIG. 38 |
| 3,348,823 | 10/1967 | Roquerre | 261/DIG. 38 |
| 3,354,898 | 11/1967 | Barnes | 123/124 R |
| 3,875,922 | 4/1975 | Kirmiss | 261/DIG. 38 |
| 4,075,296 | 2/1978 | Orsini | 261/DIG. 38 |

*Primary Examiner*—Ronald H. Lazarus
*Attorney, Agent, or Firm*—McGlew and Tuttle

[57] ABSTRACT

In a carburetor for an internal combustion engine having a primary air passage with an air valve therein and a fuel inlet port, an improvement comprising, a valve needle member having a portion extending into the fuel inlet port to a selected extent for varying the flow of fuel through the fuel inlet port and into the primary air passage. A secondary air passage is defined within the valve needle member to provide a secondary flow of air into the primary air passage. The secondary flow of air enhances mixture of the fuel and further regulates the flow of air in the primary air passage. A secondary air passage regulating body is resiliently held within the secondary air passage to selectively restrict the flow of air within the secondary air passage depending upon the position of the air valve in the primary air passage to at all times provide the proper flow of air within the primary air passage to induce full combustion of the fuel entering through the fuel inlet port.

7 Claims, 7 Drawing Figures

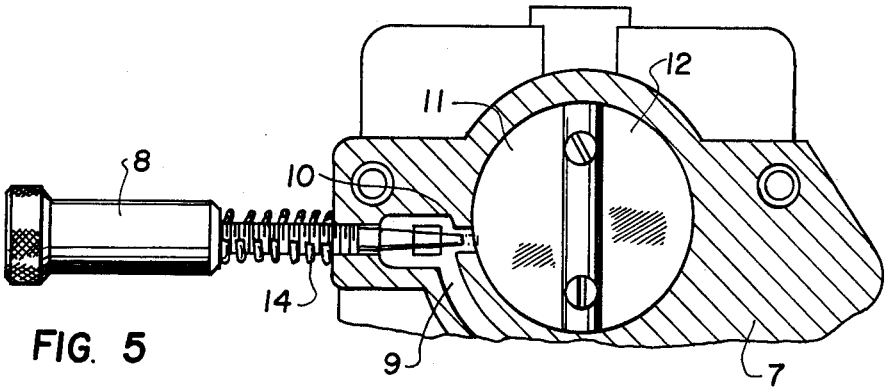
FIG. 5
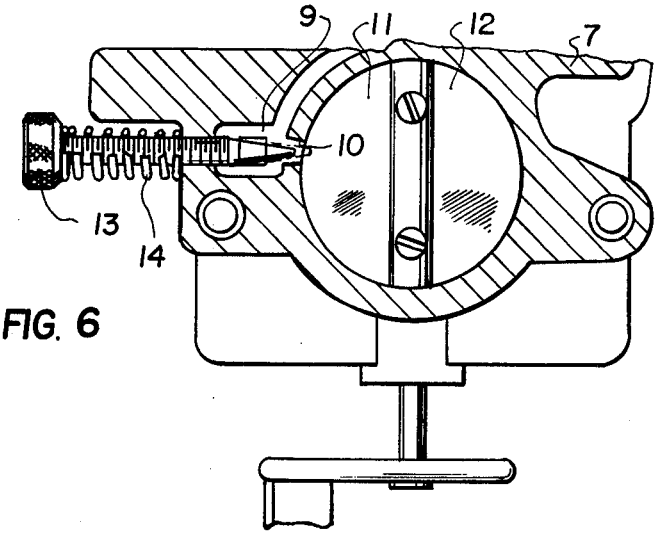
FIG. 6
FIG. 7
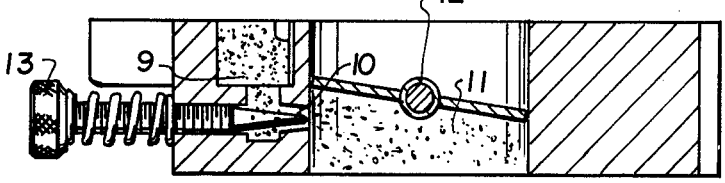

MIXTURE REGULATING DEVICE

FIELD AND BACKGROUND OF THE INVENTION

This invention relates in general to means for proportioning the air-gasoline mixture in internal combustion engines. In particular the invention refers to a new and useful device for regulating the air-gasoline mixture in the carburetors of gasoline engines.

This invention concerns itself with a self-regulating device to be applied to carburetors in substitution of the fixed needle for regulation of minimum speed in said engines, the device providing a precise air-gasoline mixture during minimal rotation and acceleration speeds.

DESCRIPTION OF THE PRIOR ART

In many countries strict measures have been established and proposed for the future in relation to regulations for the protection of the environment. In particular reduction has been sought of the contents in the air of solid and gaseous substances such as carbon monoxide and carbon dioxide, sulfurated compounds, etc. that originate mostly from the use of internal combustion engines.

It has been recently estimated that in the city of Caracas, Venezuela a daily amount of 154 tons of contaminants is discharged into the atmosphere. These contaminants are produced in part by motor vehicles and the rest of public and private incinerators. This gives an indication of the serious deterioration of the environment caused by the emissions of motor vehicles.

On the other hand, it has been determined that a large portion of the total contaminants caused by gasoline vehicles, originates from a particular arrangement of the carburetors of these vehicles, which produces an incomplete combustion having the aforementioned results.

As it is known, in gasoline engines there is provided a theoretical air-fuel mixture in a ratio of 14/16 to 1, which mixture should allow the optimal operation of the engine. However, in practice, and especially during idling or minimum speed, carburetors are manufactured with a tolerance in the minimum speed adjustment that provides a gasoline mixture enriched by 30% in a manner such as to make possible the compensation of failures proper of the critical functioning due to the low level of revolutions in which dead gaps between the periods of the combustion cycle considerably increase, as well as to the remaining non-utilizable gases that are left in the cylinders in each complete cycle.

Additionally, the minimum-speed adjustment needle has been deviced for an adjustment that is regulatable, but fixed once the presumably optimal point for functioning has been found not only for a certain altitudinal level but also for the variations of atmospheric pressure commonly encountered in the course of a vehicle operation as consequence of variations in altitude.

SUMMARY OF THE INVENTION

The application of the instant invention is particularly oriented to vehicles in cities whose heavy traffic compels those vehicles to run at minimum speed and at idle for relatively long periods of time.

Summarizing the foregoing, it is concluded that one of the main causes of the contaminating effect of vehicles is the fixed adjustment of their carburetors for situations that continuously vary both in the traffic of vehicles proper and in the atmospheric pressure, which variations, even though unnoticeable from the point of view of operation of the motor, are decisive in respect to the amount of emission of toxic gases, unburnt solids and fuels, this last feature being of the utmost importance both from the economic point of view of the user and from the point of view of waste of a non-renewable resource.

It is thus an object of the instant invention to provide a device for regulating the air-gasoline mixture in precise ratios independently of the speed conditions of the motor.

Another object of the invention is to provide a device for regulating the air-fuel mixture that permits savings in fuel of from 25 to 40%.

Still another object of the invention is to provide a device that permits the elimination of a substantial proportion of contaminating gases and solids resulting from incomplete combustion.

A further object of the invention is to provide a device that permits the use of low-octane gasoline with an equal or higher yield in the high-compression motors.

An additional object of the invention is to provide a device that permits a more flexible ignition.

One more object of the invention is to provide a device that does not require any modifications in the carburetor or motor aside from substituting the device of the invention for the valve of the minimum-speed regulating needle.

A still further object of the present invention is to provide an improvement in the needle valve for carburetors of internal combustion engines which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the Drawings:

FIG. 5 is a top sectional view of the embodiment shown in FIG. 4;

FIG. 6 is a top sectional view similar to that of FIG. 5 showing a conventional needle valve structure; and FIG. 7 is a view similar to FIG. 4 showing a conventional needle valve structure.

DESCRIPTION OF THE PREFERRED EMBODIMENT

Figure 1:
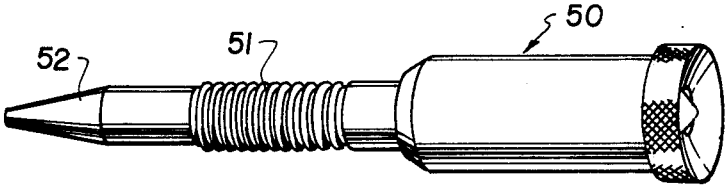
FIG. 1 is a side perspective view of the improved needle valve member in accordance with the invention.

Referring now to the drawings in particular, the invention embodied therein comprises in FIG. 1 a needle valve member generally designated 50 having a threaded portion 51 intended to be threaded into a suitably provided threaded bore in a standard internal combustion carburetor. Needle valve member 50 also includes a tapered nose portion 52 which partially extends into the seat or fuel inlet port of the carburetor to partially block the flow of fuel therethrough.

Figure 2:
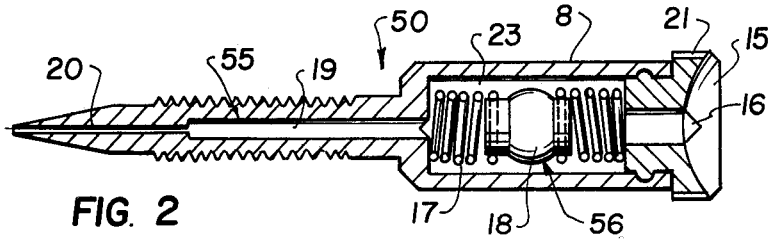
FIG. 2 is a cross-sectional view of the embodiment shown in FIG. 1.
Figure 3:
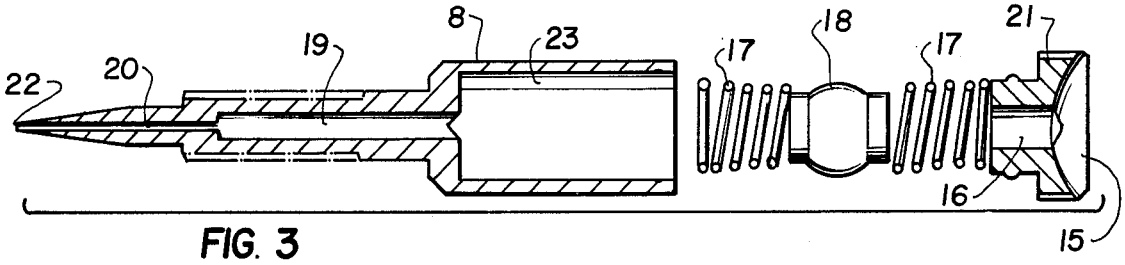
FIG. 3 is a partially in section exploded view of the embodiment shown in FIG. 2.
Figure 4:
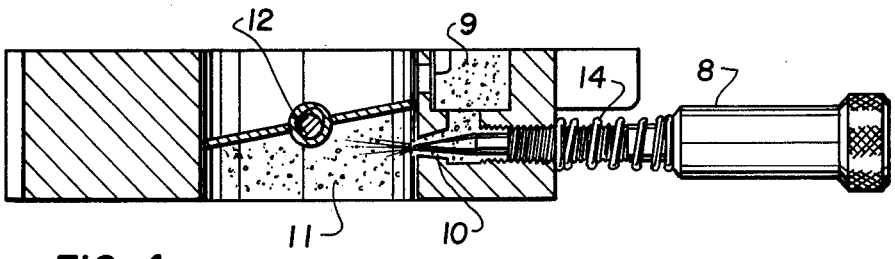
FIG. 4 is a side sectional view of a portion of the base of a carburetor utilizing the inventive needle valve member.

Referring now to FIG. 2, means within the needle valve member 50 are provided for defining a secondary air passage generally designated 55 for the passage of additional air into a carburetor. Within a large diameter chamber 23 is disposed a secondary air passage regulating means generally designated 56 which selectively constricts the flow of air within the secondary air passage 55 depending on the pressure conditions exposed thereto.

The body of a carburetor 7 comprises an airvalve or butterfly valve 12, a chamber 11 for pouring the minimum-speed mixture below the butterfly 12 where coincide the fuel conduit 9 and the regulatable and self-regulating air-passage needles 13 and 8, respectively, that include a retention spring 14.

The self-regulating needle valve 8 comprises a longitudinally perforated body determined by a chamber 23 that continues through a conduit 19 of lesser diameter and successively through another conduit 20 of still lesser diameter until reaching a discharge end 22 of conical external outline. A closure of said chamber at the end of chamber 23 is defined by a perforated lock nut 21 having a concave head 15.

In the space of chamber 23 is disposed the regulating means in the form of an oscillating compensation piston 18 supported between two springs 17 and having a relatively ample displacement within said chamber 23.

As explained before, in a conventional arrangement of a carburetor (see FIG. 6 and 7), there is used a regulatable needle 13 in a fuel port 10 for the passage of gasoline in combination with an orifice for passage of air, said needle being fixed during engine operation although regulatably adjusted. This causes the mixture to remain unchanged at that point under any speed.

The self-regulating needle of the invention now provides, in accordance with the speed of the motor, an automatic adjusting means of the air-gasoline mixture, particularly in the low-speed condition. As it has been seen, the needle device of the invention is longitudinally perforated with a displaceable internal piston, and the whole is arranged in substitution of a conventional needle.

In the condition of minimum speed the butterfly valve 12 of the carburetor is closed whereby an increase of negative pressure is produced below said butterfly, said increase determining the suction of gasoline through the minimum-speed conduit, which suction is adjusted by the external conic surface of the needle on the respective seat. In this condition the piston 18 does not move, since the scarce pressure of the absorption of the motor allows only a sufficient passage of air from the outside, which air passes through the conduit gauged according to the device, giving to the air-gasoline ratio exactly the value that corresponds to the optimal non-enriched mixture.

At the moment of acceleration there comes into play the piston 18 that in its oscillating motion adapts to those variations providing an effect of air "injection" and cooperating in the mixture of the additional fuel emitted by the acceleration pump.

In the conditions of high speed wherein the butterfly of the carburetor in wholly or approximately open, the suction at the injection point of the device 8 decreases by function of the volume of air that is supplied by the throat of the carburetor, wherefore in this situation the device remains practically idle, while nevertheless allowing the passage of air through its internal space.

I claim:

1. In a carburetor for an internal combustion engine having a primary air passage with an air valve therein and a fuel inlet port, the improvement comprising, a needle valve member having a portion extendable into the fuel inlet port to a selected extent for bearing a flow of fuel through the fuel inlet port and into the primary air passage, means in said needle valve member defining a secondary air passage into the primary air passage, secondary air passage regulating means in said secondary air passsage for variably restricting a flow of air in said secondary air passage depending on an acceleration of the internal combustion engine, said secondary air passage comprising a large diameter chamber having said secondary air passage regulating means resiliently mounted therein, said secondary air passage regulating means comprising an air displacement body resiliently supported within said large diameter chamber in a normally open position for the passage of air through said secondary air passsage, said air displacement body being movable against its resilient support to restrict a flow of air in said secondary air passage in an oscillating manner when the internal combustion engine accelerates.

2. The improvement of claim 1 wherein said needle valve member comprises a tapered nose portion extending into the fuel inlet port an end opening, said means defining a secondary air passage in said needle valve member including a conduit extending axially through said needle valve member and terminating at said end opening.

3. The improvement of claim 1 further including a pair of springs connected at opposite ends of said displacement body and engaged with the interior of said large diameter chamber for resiliently mounting said displacement body.

4. The improvement of claim 1 wherein said needle valve member further includes a threaded portion, the carburetor including an internally threaded bore adjacent the fuel inlet port for accepting said threaded portion of said needle valve member, said conduit comprising said secondary air passage further including a first small diameter portion extending from said large diameter chamber toward said tapered nose portion, a second smaller diameter portion extending between said first small diameter portion and said end opening of said needle valve member.

5. The improvement of claim 3, wherein said displacement body includes a spherical mid-portion of a diameter less than that of said chamber and cylindrical end portions.

6. The improvement of claim 5, further including a lock nut connected into one end of said large diameter chamber and having an aperture extending therethriugh communicating with the interior of said large diameter chamber, said air displacement body including a mid-spherical portion of a diameter less than that of said large diameter chamber and a cylindrical end portion on either end thereof, each of said cylindrical end portions embraced by one of said springs, said air displacement body in its normally open position being spaced from said aperture for a flow of air through said aperture and into said large diameter chamber.

7. The improvement of claim 6, wherein said lock nut further includes a concave head portion communicating with said aperture.

* * * * *